US006369526B1

(12) United States Patent
Pogadaev et al.

(10) Patent No.: US 6,369,526 B1
(45) Date of Patent: Apr. 9, 2002

(54) METHOD AND DEVICE FOR OPERATING ELECTRONIC BALLASTS FOR HIGH INTENSITY DISCHARGE (HID) LAMPS

(75) Inventors: Vladimir Pogadaev; Boris Blyashov, both of Jerusalem (IL)

(73) Assignee: JBP Technologies, Ltd., Jerusalem (IL)

( * ) Notice: Subject to any disclaimer, the term of this patent is extended or adjusted under 35 U.S.C. 154(b) by 0 days.

(21) Appl. No.: 09/600,207

(22) PCT Filed: Jan. 20, 1999

(86) PCT No.: PCT/IL99/00034

§ 371 Date: Jul. 12, 2000

§ 102(e) Date: Jul. 12, 2000

(87) PCT Pub. No.: WO99/40757

PCT Pub. Date: Aug. 12, 1999

(30) Foreign Application Priority Data

Jan. 22, 1998 (IL) ..... 123029

(51) Int. Cl.[7] ..... H05B 37/02
(52) U.S. Cl. ..... 315/307; 315/224; 315/244
(58) Field of Search ..... 315/307, 224, 315/244, 308

(56) References Cited

U.S. PATENT DOCUMENTS 4,170,747 A * 10/1979 Holmes ..... 315/307
5,677,602 A * 10/1997 Paul et al. ..... 315/224

FOREIGN PATENT DOCUMENTS

JP 01315995 12/1989

* cited by examiner

*Primary Examiner*—David Vu
(74) *Attorney, Agent, or Firm*—Scully, Scott, Murphy & Presser

(57) ABSTRACT

A method and device for operating electronic ballasts for high intensity discharge lamps, the ballasts having a driver, two power switches, an LC series circuit, a driver controller, a current sensor, and a power sensor. The method includes the steps of (a) generating pulses of frequency f1 for a time t1, equal to n/f1, where f1 equals the LC resonance frequency; (b) monitoring the existence of current and (c) monitoring the current in the lamp circuit, and proceeding to (h) upon determining that there is no current in the lamp circuit, (d) continuing pulse generation for a time t2; (e) switching the frequency f2, at which a set power is reached; (f) monitoring and stabilizing the lamp power by modifying f2, and proceeding to step (h) when the set power is exceeded; (g) monitoring current and power according to steps (c) and (f); h) inhibiting pulse generation for a time approximately equal to t2/k; (i) proceeding to step (a) until t2 has elapsed; and (j) inhibiting pulse generation until power is switched off and on.

21 Claims, 7 Drawing Sheets

METHOD AND DEVICE FOR OPERATING ELECTRONIC BALLASTS FOR HIGH INTENSITY DISCHARGE (HID) LAMPS

TECHNICAL FIELD

The present invention relates to the field of electronic solid state ballasts for High Intensity Discharge (HID) lamps, and more specifically, it relates to a method and device utilizing solid state ballasts for operating HID lamps, e.g., High Pressure Sodium (HPS) lamps.

BACKGROUND ART

The term "discharge lamp" refers to a lamp in which the electric energy is transformed into optical radiation energy when electric current is passed through a gas, metal vapor, or a mixture thereof, present inside the lamp.

Presently, various circuits of electronic ballasts for discharge lamps, and in particular for fluorescent lamps, are known in the art. A specific example is the circuit shown in FIG. 1, which uses two power switches $PS_1$ and $PS_2$ in a totem pole (half-bridge) topology, the tube circuit consisting of an L-C series resonant circuit. The power switches represented by power MOSFETS are driven to alternatively conduct, e.g., by a MOS Gate Driver (IR2155)(MGD). The MGD provides a high frequency (20 to 80 kHz) square wave output, with the frequency of oscillation given by:

$$f_{osc} = \frac{1}{1.4R_T C_T}.$$

Prior to striking the fluorescent lamp 2, the resonant circuit consists of L, $C_1$ and $C_2$ connected in series. Since $C_2$ has a lower value than $C_1$, it operates at a higher AC voltage than the latter, and in fact, it is this higher voltage that strikes the lamp. After the lamp strikes, $C_2$ is effectively shorted by the lamp voltage drop, and the resonant frequency of the circuit is now determined by L and $C_1$.

Under resonance conditions, the sinusoidal voltage across the lamp is amplified by a factor of Q (Q being the circuit quality factor) and the amplitude of this voltage attains a value sufficient for striking the lamp, which thereafter gives a non-blinking light.

The above-described basic circuit is well-suited for fluorescent lamps, but will not adequately work for arc discharge lamps or HID lamps.

Initially, the HID lamp is an open circuit. Short pulses of voltage suffice to strike the lamp, provided the pulses are of adequate amplitude (about 4,500 Volts). Subsequent to striking, the resistance of the lamp drops drastically and then slowly rises to its normal operating level. Hence, to prevent lamp damage subsequent to striking and during the warm-up, the current of the lamp must be restricted.

It is a characteristic of HID lamps that their voltage increases over the life of the lamp, due to a slow increase of stabilization temperature. Therefore, unless the lamp ballast maintains the lamp power, the light output of the lamp will vary to an unacceptable degree.

Ballast devices for HD lamps should be different from ballasts for fluorescent lamps, for the following main reasons:

1) these devices should withstand open-circuit operation conditions;
2) they should supply sufficiently high power for striking the lamp at a voltage of 3 to 4 kV;

3) they should adapt themselves to large variations of the lamp voltages;
4) the ballasts should not destabilize the lamp arc discharge, and
5) the ballasts should be compatible with lamp characteristics, so as to maximize the lamp's service life.

Therefore, when replacing the fluorescent lamp of FIG. 1 with an HID lamp 4, as shown in FIG. 2, the ballast of FIG. 1 will not operate the HD lamp, for the following major reasons:

An HID lamp is not consistently susceptible to striking and is not necessarily in a state of readiness for striking. In fact, the circuit of FIG. 1 enables a low power (70–150 W), cold HID lamp to be struck and even brought to the operation mode. But if the lamp has operated at rated power and is shut off for some reason, the subsequent attempt to switch on the hot lamp will prove to be unsuccessful and will damage the main components of the circuit, first of all, the power switches.

As can be seen in FIG. 2, the oscillation circuit is shorted only when the lamp is struck (the lamp shortens the $C_2$ capacitor). In all other situations, when the lamp is not struck; the lamp is not present; the lamp is damaged; the lamp circuit is broken, etc., the oscillation circuit is not shortened, which inevitably results in a failure of the device.

Therefore, the direct use of an electronic ballast intended for fluorescent lamps in HID lamp circuits is ruled out, since it is impossible for such a ballast to provide reliable operation of an HID lamp under actual operating conditions.

It is thus a broad object of the present invention to provide a method for operating HID lamps with devices built according to the basic topology of electronic ballasts for fluorescent lamps, which takes into account significant physical and design features of these lamps, such as their insusceptibility to striking and the fact that in the absence of a lamp in the circuit, the series L-C circuit is not broken. The method thus provides optimal conditions for striking, heating and operation of HID lamps.

DISCLOSURE OF THE INVENTION

The invention provides a method for operating electronic ballasts for High Intensity Discharge (HID) lamps, said electronic ballasts having a driver, two power switches connected in a half-bridge arrangement, an LC series circuit, a driver controller for controlling the operation of the driver, a current sensor in the lamp circuit, and a power sensor in the power switch circuit, said method comprising (a) generating pulses of frequency $f_1$ for a duration of time $t_1$ being equal to $n/f_1$, where n is a positive number, and $f_1$ equals the resonance frequency of the ballast's LC series circuit; (b) monitoring the existence of current in the lamp circuit after the duration of time $t_1$ has elapsed, and in the event that there is no current in the lamp circuit, proceeding to step (h); (c) monitoring the current in the lamp circuit, and proceeding to step (h) upon determining that the current in the lamp circuit has ceased to flow; (d) continuing the generation of said pulses of frequency $f_1$ for a predetermined duration of time $t_2$ counting from the start of the generation of said pulses according to step (a); (e) switching the frequency $f_1$ of said pulses to an operating frequency $f_2$, at which a set power for the lamp is reached; (f) monitoring the power on the lamp and stabilizing this power at the level of the power set for the lamp, by gradually modifying the frequency $f_2$, and proceeding to step (h) in the event that the power in the lamp circuit exceeds the power set for the lamp by a given margin; (g) monitoring the current in, and power of, the lamp circuit according to steps (c) and (f); (h) inhibiting the generation of said pulses for a predetermined duration of time exceeding $t_1$ and approximately equal to $t_2/k$, where k is a positive number; (i) proceeding to step (a) until the said predetermined duration of time $t_2$, counted from the start of the generation of pulses according to step (a), has elapsed; and (j) inhibiting the generation of said pulses until the power to the ballast is first switched off and then on.

In accordance with the invention, there is also provided a device for operating electronic ballasts for High Intensity Discharge (HID) lamps, said electronic ballasts having a driver, a power switching circuit including two power switches connected in a half-bridge arrangement, and an LC series circuit, said device comprising a driver controller for controlling the operation of said driver, a current sensor connected on a line leading and adjacent to an electrode of the HID lamp, and a power sensor incorporated in the power switching circuit.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION

Figure 1:
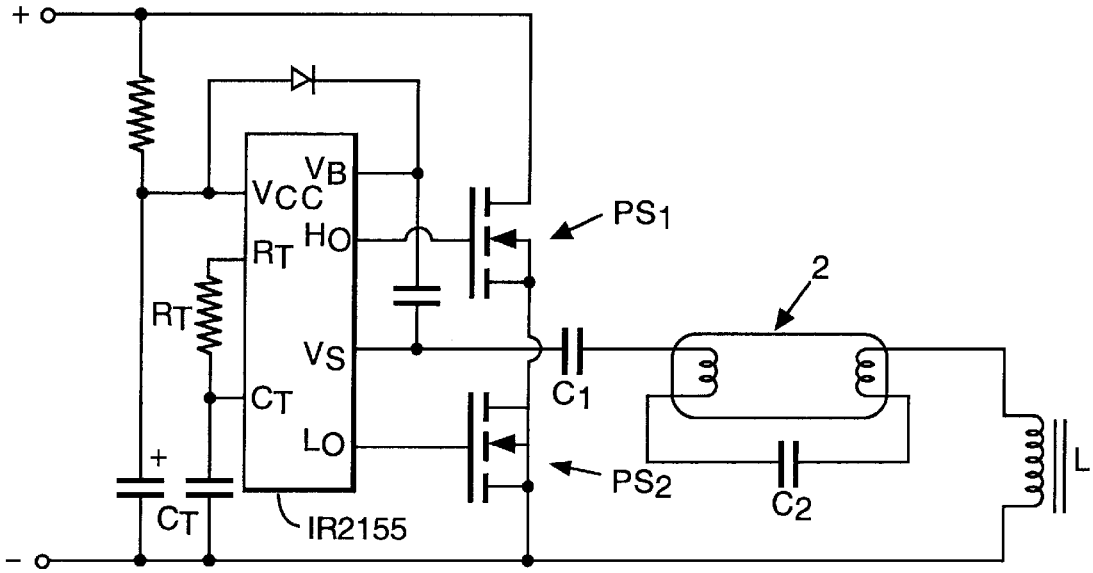
Fig.1. Prior Art
FIG. 1 shows a typical circuit diagram of a prior art electronic ballast for operating fluorescent lamps.
Figure 2:
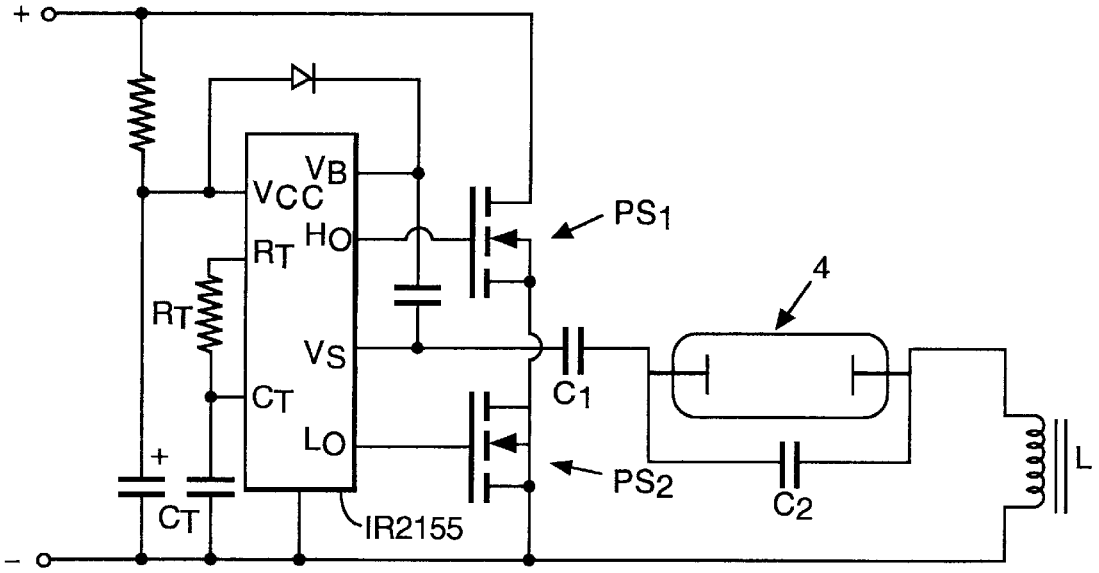
FIG. 2 shows the circuit diagram of FIG. 1, in which a fluorescent lamp is substituted by an HID lamp.
Figure 3:
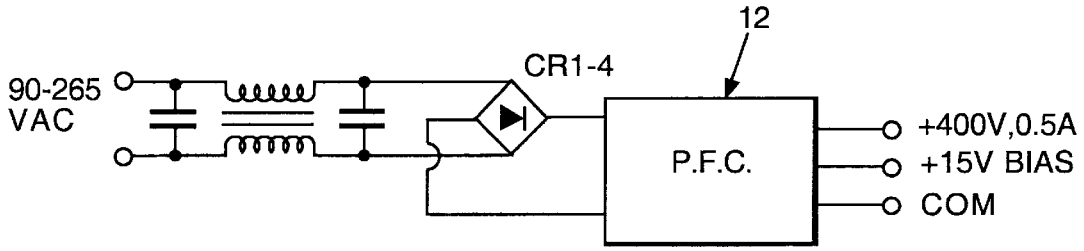
FIG. 3 shows a device utilizing solid state ballasts for operating HID lamps in accordance with a first embodiment of the present invention.
Figure 3:
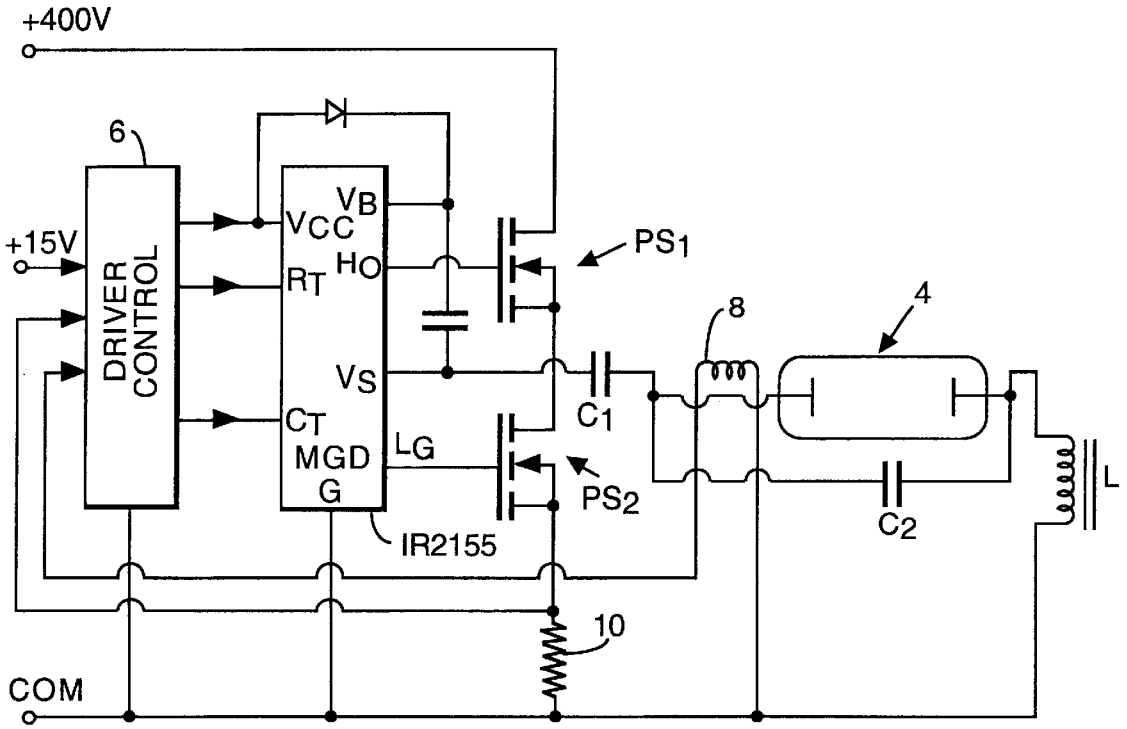

Referring to FIG. 3, there is shown a circuit for igniting and operating HID lamps utilizing solid state ballasts. In addition to the circuit's per se known components, described above with reference to FIGS. 1 and 2, the circuit also includes a driver controller 6, an induction-type current sensor 8 connected in circuit on the line leading and adjacent to an electrode of the lamp, and a lamp power sensor 10 incorporated in the power switch circuit on the common conductor. In addition, there is illustrated a power supply 12 adapted to provide the power suitable for the specific, non-limiting, example illustrated in the drawing for operating the electronic ballast circuit of a 400 W HID lamp.

Figure 4A:
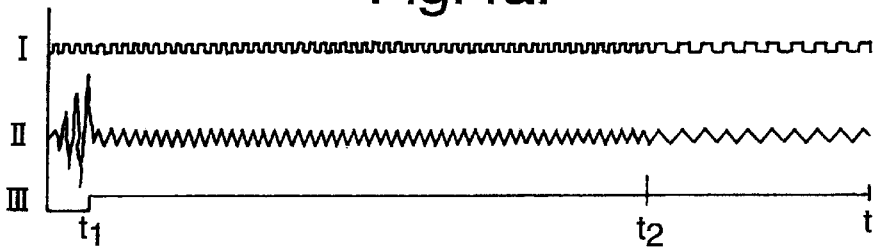
FIGS. 4*a*–4*e* show waveforms of progressive cycles for ignition, warm-up and operation of an HID lamp.
Figure 4B:
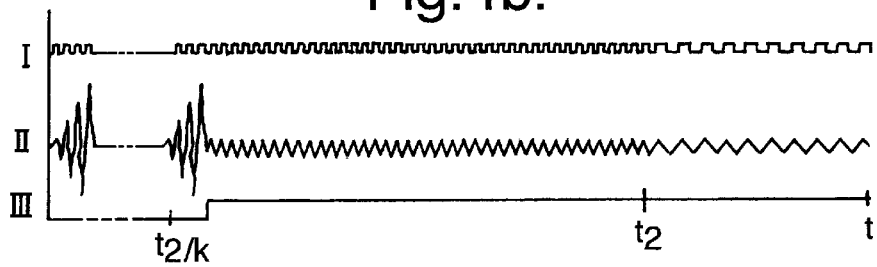
Figure 4C:
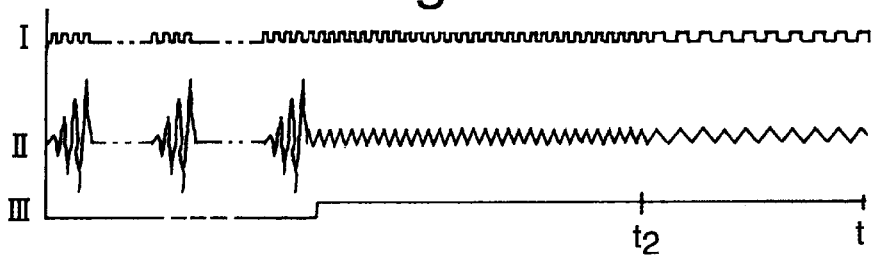
Figure 4D:
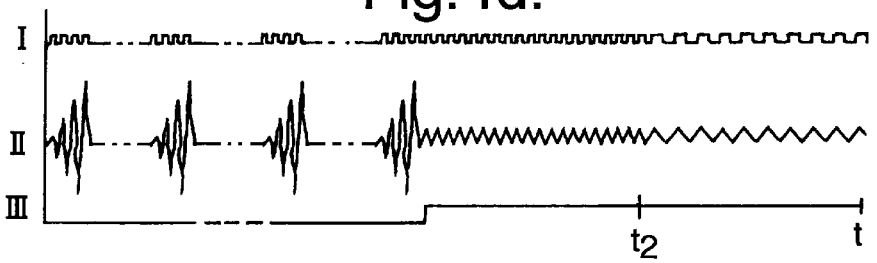
Figure 4E:
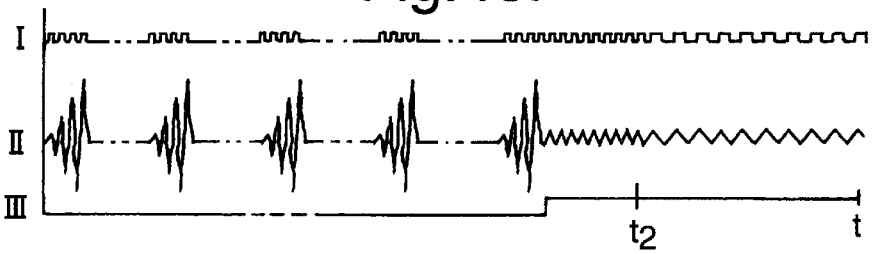
Figure 5:
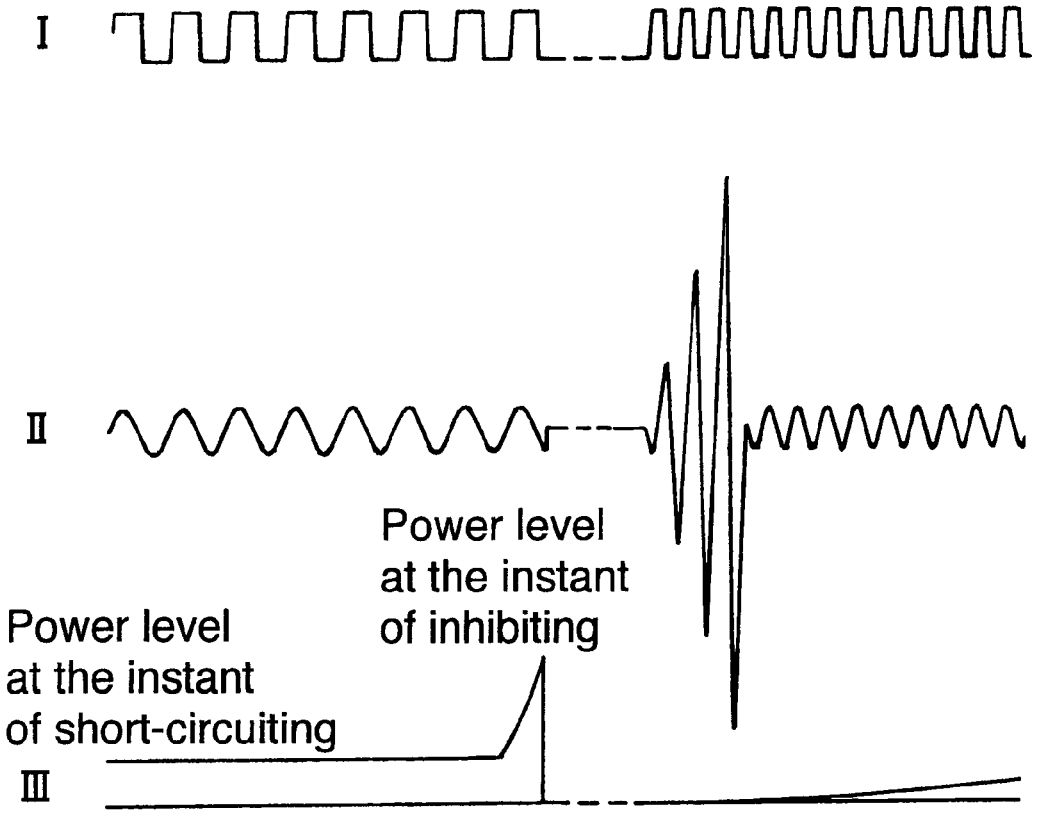
FIG. 5 illustrates waveforms in the event of lamp short-circuiting.
Figure 6:
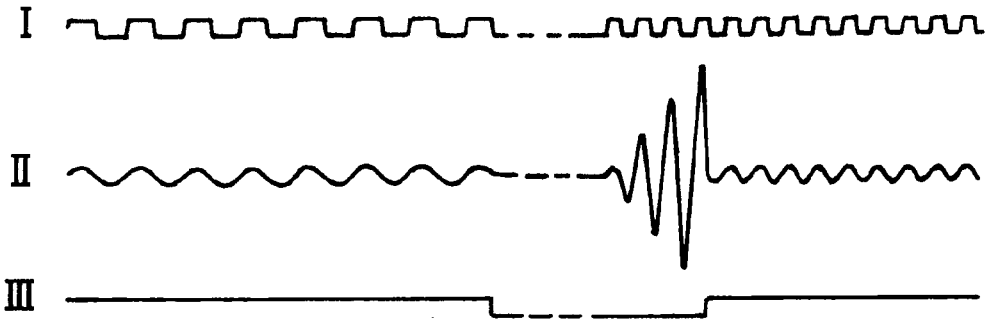
FIG. 6 illustrates waveforms in the event of lamp circuit malfunction.

Reference is now also made to FIGS. 4–6.

Upon the application of power from the power supply 12 to the circuit, the driver MGD produces and applies the preset required voltage and current. As shown in FIG. 4, waveform I represents the driver's output voltage; waveform II represents the voltage on the lamp 4; and waveform III represents the current on sensor 8.

The striking of the HID lamp, of a selected set power, is effected by generating pulses having a pulse frequency $f_1$ which equals the resonance frequency of the ballast's LC series circuit, e.g., about 50 kHz, for a duration of time $t_1=n/f_1$, where n is a positive number from 3 to 10. Over the course of this duration, all electronic components of the output stage withstand the current spikes, which far exceed the operation mode current. However, if the striking pulses, of a duration of $n/f_1$ seconds, fail to strike the lamp, pulse generation stops. The next attempt to strike the lamp by similar striking pulses is carried out after a duration of time $t_2/k$, where k is a positive number, e.g., within about 20 seconds, as seen in FIG. 4*b*. The positive numbers n and k may be constant or non-constant.

Since the longest time required for a hot HID lamp to cool down so that it is again susceptible to striking will be about 2 minutes, the number of striking pulses applied should be at least six (see FIGS. 4*c* to 4*e*).

The time which passes before striking the HID lamp, i.e., the number of groups of pulses striking the lamp before ignition, varies in a discrete manner and depends on the state of the lamp and readiness thereof for striking. For example, a cold lamp in good working condition is struck by the first striking pulses (FIG. 4*a*), and on the other hand, a hot lamp is struck by one of the subsequent striking pulses, depending on the "warm-up level" of the lamp (FIGS. 4*b*–4*e*). It is clear that, once the lamp is struck, the generation of frequency $f_1$ does not cease and, as soon as the initial warm-up stage is over (within about 2 minutes, counting from the first application of the first striking pulses), it is switched to a working or operating frequency $f_2$, e.g., about 30 kHz, and the lamp continues to warm up until the operation mode is reached. The signal confirming that the lamp ignited originates at the current sensor 8, located in the lamp circuit.

An HID lamp is known to require a peak voltage of 3 to 4 kV for being struck by a single pulse having a duration of not less than 1 microsecond. Providing a train of high voltage pulses for striking, decreases the required striking voltage of the lamp. In this particular example, the required voltage does not exceed 3 kV.

The operation mode of the driver MOD takes into consideration all of the special features of HID discharge lamps, and thus reliably provides for striking, warming up, and normal operation mode. Hence, the driver controller 6 governs the driver's operation and initial preset warm-up frequency $f_1$. The frequency $f_1$ exceeds the operation frequency and is determined in such a way that the lamp's initial warm-up current is limited. This results in the reduction of erosion of the lamp's electrodes and thus contributes to the increase of the lamp's service life. Once the lamp is ignited, the driver controller 6 controls the lamp's operation frequency $f_2$. Due to the feedback obtained from the power sensor 10, the working frequency varies smoothly in such a manner that the illumination is maintained at a constant preset level, or decreased to a level given by the setting of the driver controller. Hence, the power on the lamp is stabilized at the level of the power set for a particular lamp, by gradually modifying the frequency $f_2$.

Furthermore, the driver controller 6 also governs the inhibition of the driver's operation and in the event of a sharp increase of the load power, e.g., in case the lamp line short-circuits, the power sensor 10 signal exceeds the rated power by a given margin and the driver controller 6 inhibits the driver's operation for a duration $t_2/k$, e.g., for about 20 seconds, following which the driver controller 6 switches to the initial operation cycle as illustrated in FIG. 5, wherein I is the driver's output voltage, II is the voltage on the lamp 4, and III is the signal of the power sensor 10.

If the cause of failure is not eliminated within the next two minutes or so, the driver controller 6 inhibits the driver's operation until the power supply 12 is switched off and then is subsequently switched on.

Similarly, the driver controller 6 inhibits the driver's operation on receiving a signal from current sensor 8, indicating that the lamp circuit current is stopped due to lamp line breakage, lamp failure, etc., as shown in FIG. 6, wherein I is the driver's output voltage, II is the voltage on the lamp 4, and III is the signal of the current sensor 8.

Figure 7:
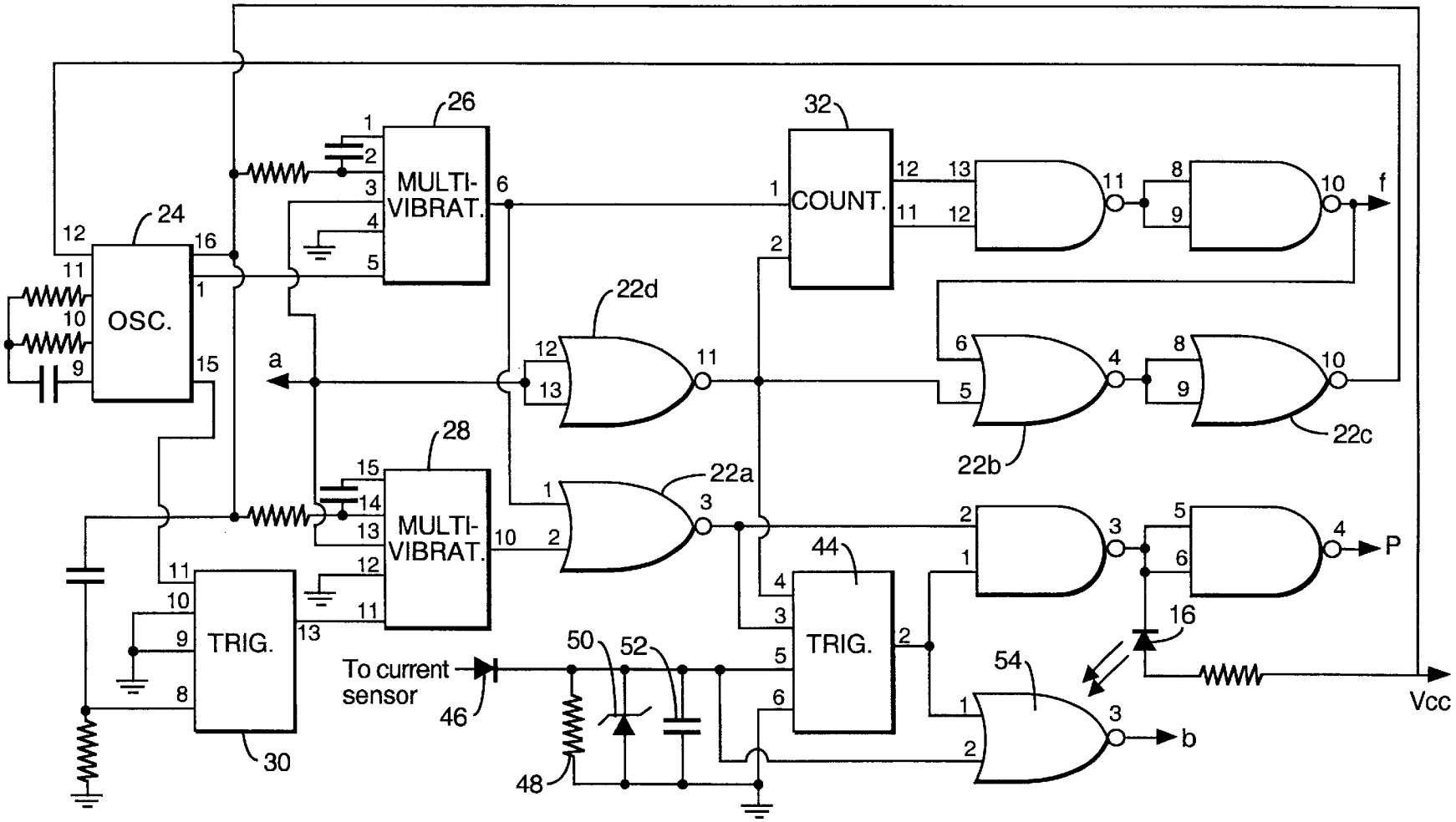
FIG. 7 is a detailed circuit diagram of the driver controller, mainly showing the digital part thereof.
Figure 8:
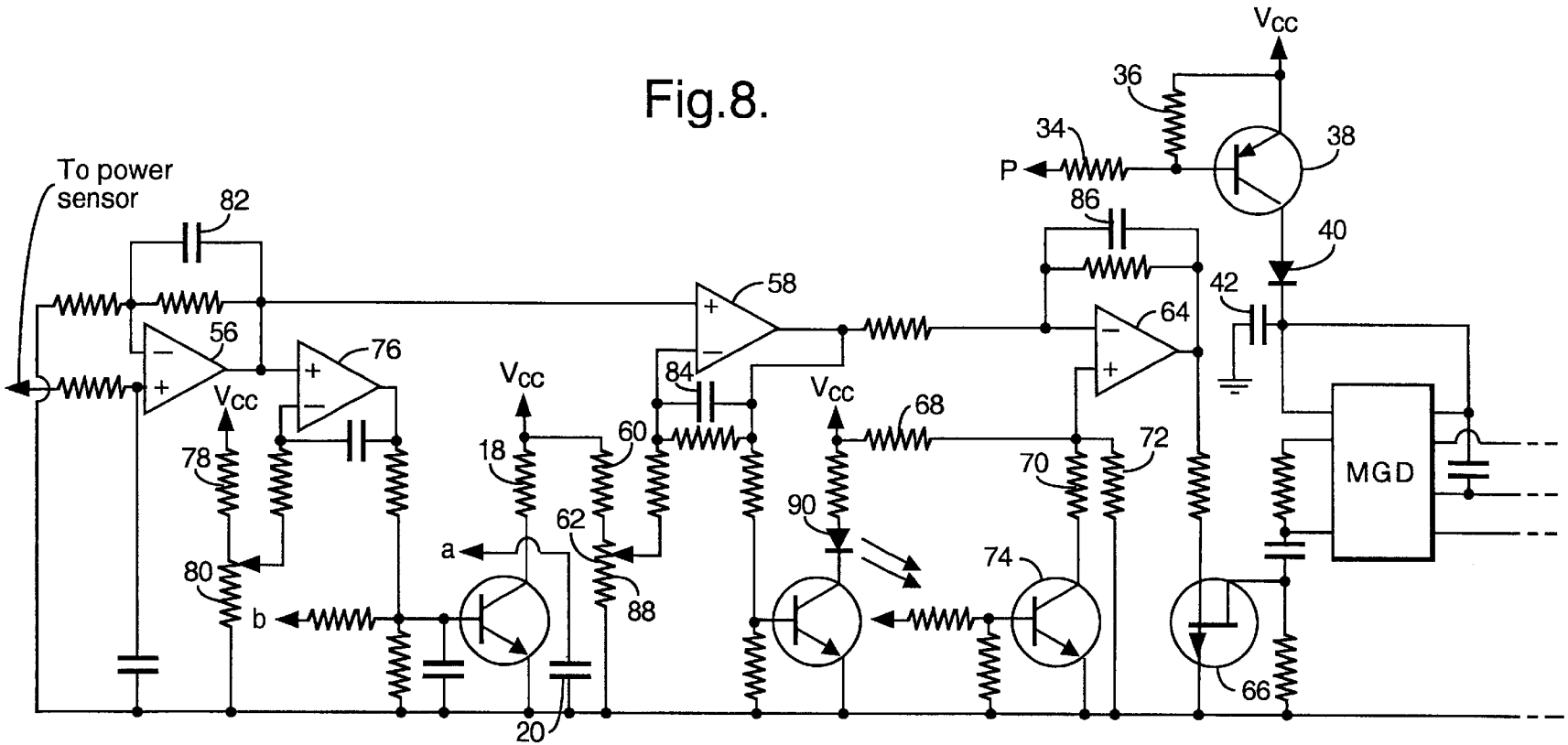
FIG. 8 is a detailed circuit diagram of the driver controller, mainly showing the analogue part thereof.

Referring to FIGS. 7 and 8, there is illustrated, by way of example only, a possible embodiment of the controller's detailed circuit diagram.

In general, the digital part of the driver controller (FIG. 7) sets all of the required time intervals of the lamp's ignition cycle, including its warm-up period, controls the signal from the current sensor in the lamp circuit and produces three output signals:

1) Signal P, permitting the driver to start generation of pulses;
2) Signal f, effecting switching from frequency $f_1$ to operating frequency $f_2$, and
3) Signal g, causing the switching off of the circuit in the event that no current is detected by the current sensor in the lamp circuit.

The analog part of the driver controller (FIG. 8) is responsible for maintaining the set power of the lamp, producing a reset signal in the event that the power in the lamp circuit exceeds the set power by a predetermined margin. A light indicator 90 (FIG. 8) may optionally be provided, that turns on when the lamp reaches the set power.

The RESET signal, required to bring the circuit to its initial state, is formed by components 18, 20 (FIG. 8) and 22*d* (FIG. 7). Pulses are generated by oscillator/counter 24 and repeated every 30 seconds. The duration of the pulses (100 mks) is set by monostable multivibrators 26, 28. The first pulse is generated, e.g., 4 seconds after power is supplied to the circuit, by the additional trigger 30. Binary counter 32 sets oscillator/counter 24 to reset after a two-minute interval, and also forms a signal f for switching from frequency $f_1$ to operating frequency $f_2$. Pulses of 100 mks each are fed to the circuit activating the driver, consisting of resistors 34, 36, transistor 38, diode 40 and capacitor 42, and to trigger 44. When the lamp is struck, the current sensor 8, together with the circuit composed of the diode 46, resistor 48, stabilatron 50 and capacitor 52, form a logical "one" signal that sets the trigger 44, thereby allowing the subsequent operation of the driver. Component 54 forms the RESET signal in the event that there is no signal from the current sensor 8 and its associate circuit. LED 16 indicates that trigger 44 is brought to RESET, namely, that the circuit is in its initial state. LED 16 turns off during the lamp ignition and subsequent normal operation.

The circuit for controlling the power includes a non-inverting amplifier 56 having an amplification factor of, e.g., 11; comparator 58 for comparing the signal from the amplifier with the voltage formed by resistors 60, 62, and inverting amplifier 64 that produces the voltage required for normal operation of transistor 66, using the bias circuit including resistors 68, 70, 72 and transistor 74. The bias voltage varies in the event that transistor 74 is closed by signal f. The generated frequency of driver MGD may vary with voltage variation at the source of transistor 66, due to the change in the capacitance of the gate/source junction. Operational amplifier 76 forms the RESET signal in the event of voltage at the output of amplifier 56 exceeding the reference signal formed by resistors 78, 80. The power controlling circuit has a deep negative feedback due to capacitors 82, 84, 86. The sensitivity threshold of comparator 58, and consequently the power on the lamp, are controlled by potentiometer 88, while the protection threshold is set by potentiometer 88. LED 90 provides an indication that the power set for the lamp has been attained.

Figure 9:
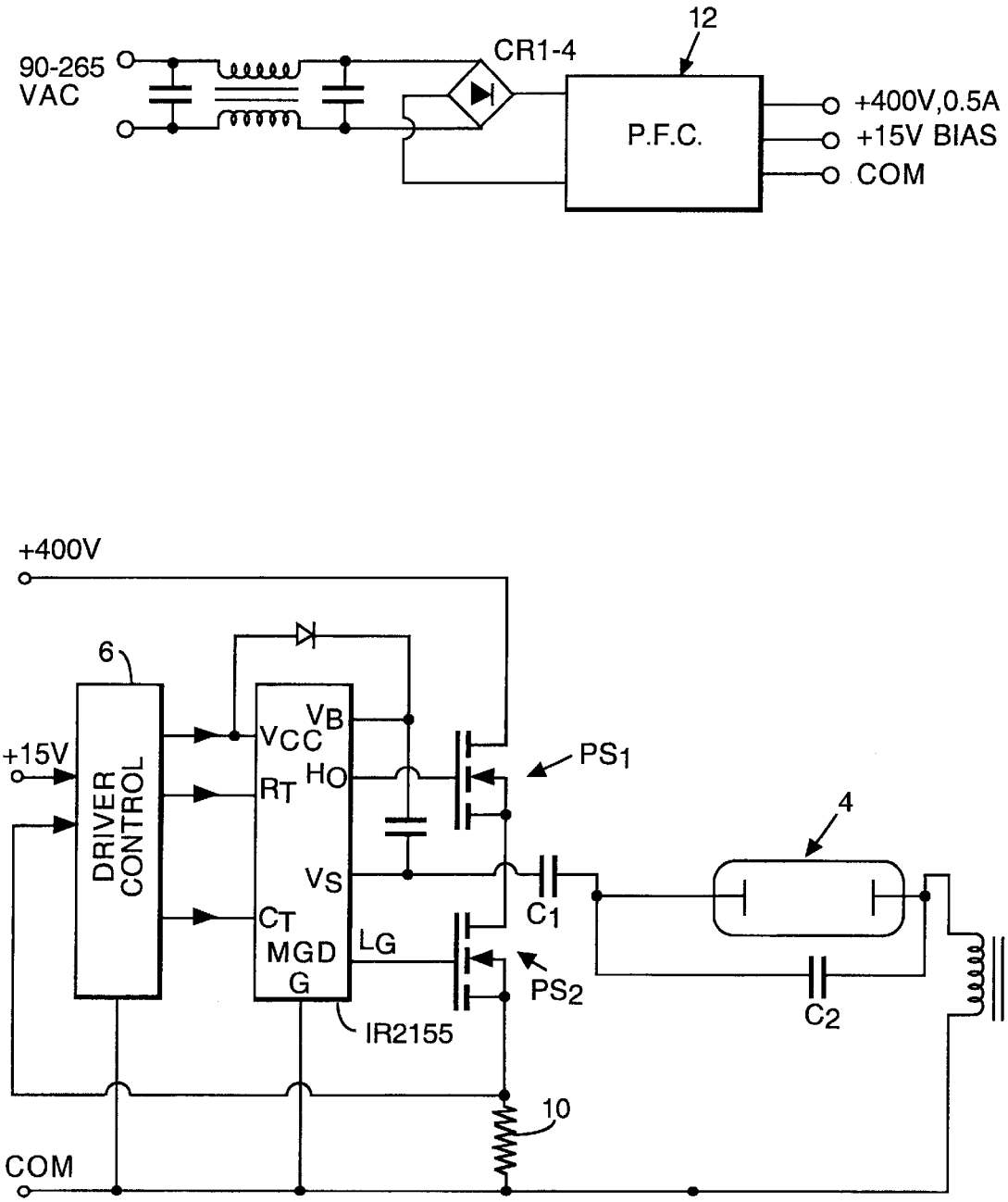
FIG. 9 shows a device utilizing solid state ballasts for operating HID lamps in accordance with a second embodiment of the present invention.

In the previous embodiment, the current sensor senses the current in the lamp circuit at resonant frequency $f_1$ after the lapse of a time period of a duration $t_1=n/f_1$. When the current is insignificant, however, this necessitates a separate current sensor, for example, an inductance sensor, which can sense low current. Hence, in accordance with the further embodiment shown in FIG. 9, an intermediate frequency $f_2$ is introduced and the current in the lamp circuit is sensed after the lapse of a period of time of a duration $t_1+t_2$, wherein $t_2=m/f_2$ and m is an integer. The introduction of the frequency $f_2$, lower than the resonance frequency $f_1$ into the working regime of the ballast, causes the current in the lamp circuit to increase. This has made it possible to sense the current in the lamp circuit with a resistance sensor, i.e., the power sensor 10 included in the circuit of the lower switch feeding the lamp 4.

It will be evident to those skilled in the art that the invention is not limited to the details of the foregoing illustrated embodiments and that the present invention may be embodied in other specific forms without departing from the spirit or essential attributes thereof The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for operating electronic ballasts for High Intensity Discharge (HID) lamps, said electronic ballasts having a driver, two power switches connected in a half-bridge arrangement, an LC series circuit, a driver controller for controlling the operation of the driver, a current sensor in the lamp circuit, and a power sensor in the power switch circuit, said method comprising:

(a) generating pulses of frequency $f_1$ for a duration of time $t_1$ being equal to $n/f_1$, where n is a positive number, and $f_1$ equals the resonance frequency of the ballast's LC series circuit;

(b) monitoring the existence of current in the lamp circuit after the duration of time $t_1$ has elapsed, and in the event that there is no current in the lamp circuit, proceeding to step (h);

(c) monitoring the current in the lamp circuit, and proceeding to step (h) upon determining that the current in the lamp circuit has ceased to flow;

(d) continuing the generation of said pulses of frequency $f_1$ for a predetermined duration of time $t_2$ counting from the start of the generation of said pulses according to step (a);

(e) switching the frequency $f_1$ of said pulses to an operating frequency $f_2$, at which a set power for the lamp is reached;

(f) monitoring the power on the lamp and stabilizing this power at the level of the power set for the lamp, by gradually modifying the frequency $f_2$, and proceeding to step (h) in the event that the power in the lamp circuit exceeds the power set for the lamp by a given margin;

(g) monitoring the current in, and power of, the lamp circuit according to steps (c) and (f);

(h) inhibiting the generation of said pulses for a predetermined duration of time approximately equal to $t_2/k$, where k is a positive number;

(i) proceeding to step (a) until said predetermined duration of time $t_2$, counting from the start of the generation of pulses according to step (a), has elapsed; and (j) inhibiting the generation of said pulses until the power to the ballast is first switched off and then on.

2. The method as claimed in claim 1, wherein n is a number from 3 to 10.

3. The method as claimed in claim 1, wherein $t_2$ is a duration of time from 2 to 15 minutes.

4. The method as claimed in claim 1, wherein k is a number from 6 to 30.

5. The method as claimed in claim 1, wherein n is constant.

6. The method as claimed in claim 1, wherein n is non-constant.

7. The method as claimed in claim 1, wherein k is constant.

8. The method as claimed in claim 1, wherein k is non-constant.

9. A method for operating electronic ballasts for HID lamps, said electronic ballasts having a PFC, a driver, two power switches connected in a half-bridge arrangement, an LC series circuit, a driver controller for controlling the operation of the driver, and a power sensor in the power switching circuit, said method comprising:

(a) generating pulses of frequency $f_1$ for a predetermined time period $t_1$, being equal to n/f; where n is a positive integer and $f_1$ is equal to the resonance frequency of the LC series circuit of the ballast;

(b) switching the frequency $f_1$ to frequency $f_2$,$f_2$ being lower than $f_1$;

(c) sensing the active power in the lamp circuit after the elapse of a predetermined time period $t_2$ equal to $m/f_2$, where m is a positive integer, and if no active power is sensed in the lamp circuit, proceeding to step (h);

(d) continuing the generation of said pulses of frequency $f_2$ during a predetermined time period $t_3$, which commences when the generation of pulses in step (a) is started;

(e) switching the frequency $f_2$ of said pulses to an operating frequency $f_3$, at which a set power for the lamp is reached;

(f) monitoring the power on the lamp and stabilizing said power at the power level set for the lamp by gradually modifying operating frequency $f_3$;

(g) monitoring active power in the lamp circuit and proceeding to step (h), provided no active power is sensed;

(h) discontinuing the generation of said pulses during a predetermined period of time approximately equal to $t_3/k$, where k is a positive integer;

(i) proceeding to step (a), until said predetermined period of time $t_3$ elapses;

(j) discontinuing the generation of said pulses for a predetermined period of time $t_4$;

(k) repeating steps (a), (b), (c)p times, wherein p is a positive integer, provided that during step (c), transfer to (h) has taken place; and (l) discontinuing the generation of said pulses until power to the ballast is switched off and subsequently switched on.

10. The method according to claim 9, wherein n is an integer from 3 to 10.

11. The method according to claim 9, wherein m is an integer from 3 to 10.

12. The method according to claim 9, wherein k is an integer from 4 to 30.

13. The method according to claim 9, wherein p is an integer from 3 to 5.

14. The method according to claim 9, wherein $t_3$ is a time period from 2 to 5 minutes.

15. The method according to claim 9, wherein $t_4$ is a time period from 10 to 20 minutes.

16. The method according to claim 9, wherein n is constant.

17. The method according to claim 9, wherein n is non-constant.

18. The method according to claim 9, wherein k is constant.

19. The method according to claim 9, wherein k is non-constant.

20. The method according to claim 9, wherein p is constant.

21. The method according to claim 9, wherein p is non-constant.

* * * * *